US007938764B2

(12) United States Patent
Gale

(10) Patent No.: US 7,938,764 B2
(45) Date of Patent: May 10, 2011

(54) CONTINUOUS FEEDER FOR PAPER FOLDING MACHINE AND PAPER FOLDING MACHINE INCORPORATING THE SAME

(76) Inventor: Greg Gale, Sagamore Hills, OH (US)

( * ) Notice: Subject to any disclaimer, the term of this patent is extended or adjusted under 35 U.S.C. 154(b) by 216 days.

(21) Appl. No.: 12/329,223

(22) Filed: Dec. 5, 2008

(65) Prior Publication Data

US 2009/0197751 A1 Aug. 6, 2009

Related U.S. Application Data

(60) Provisional application No. 60/992,437, filed on Dec. 5, 2007.

(51) Int. Cl.
*B65H 5/36* (2006.01)

(52) U.S. Cl. ..... 493/422; 493/416; 271/4.01; 271/194

(58) Field of Classification Search ..... 271/3.23, 271/4.01, 6, 10.1, 13, 276, 194; 493/416, 493/417, 418, 422

See application file for complete search history.

(56) References Cited

U.S. PATENT DOCUMENTS 3,170,685 A * 2/1965 Biggar, Jr. ..... 493/419
3,560,086 A * 2/1971 Johnston ..... 399/385
3,712,020 A * 1/1973 Norr et al. ..... 53/412
3,757,081 A * 9/1973 Smith et al. ..... 219/216
3,759,506 A * 9/1973 Eckl et al. ..... 493/418
3,807,612 A * 4/1974 Eggert ..... 226/42
3,810,315 A * 5/1974 Fleming ..... 34/655
3,865,364 A * 2/1975 Sterner ..... 271/105
4,494,316 A * 1/1985 Stephansen et al. ..... 34/68
4,594,795 A * 6/1986 Stephansen ..... 34/68
5,259,124 A * 11/1993 Poterala ..... 34/638
5,377,428 A * 1/1995 Clark ..... 34/446
5,797,327 A * 8/1998 Gieser et al. ..... 101/483
6,129,503 A * 10/2000 Schenone ..... 414/788.1
6,169,848 B1 * 1/2001 Henry ..... 392/307
6,398,206 B1 * 6/2002 Yang et al. ..... 271/90
6,543,765 B2 * 4/2003 Kerpe et al. ..... 271/195
7,392,981 B2 * 7/2008 Hahn et al. ..... 271/212

* cited by examiner

*Primary Examiner* — Christopher Harmon

(74) *Attorney, Agent, or Firm* — Curatolo Sidoti Co., LPA; Salvatore A. Sidoti

(57) ABSTRACT

A continuous paper feeder for supplying paper to be folded to a paper folding machine is provided. The continuous paper feeder includes a conveyor, a guide, a blower for introducing air between sheets of paper to be supplied to a paper folding machine, and a sensor for controlling the output of the air. The guide includes opposing first surfaces and second surfaces and a plurality of apertures communicating between the first surface and the second surfaces. The blower is adapted to introduce air through the apertures located on the guide as an operator is loading a stack of paper to be folded onto the conveyor surface.

40 Claims, 4 Drawing Sheets

CONTINUOUS FEEDER FOR PAPER FOLDING MACHINE AND PAPER FOLDING MACHINE INCORPORATING THE SAME

CROSS REFERENCE TO RELATED APPLICATIONS

This application claims the benefit of the filing date under 35 U.S.C. 119(e) of Provisional Patent Application Ser. No. 60/992,437 filed on Dec. 5, 2007, which is incorporated herein by reference in its entirety.

TECHNICAL FIELD

Provided is a continuous feeder for delivering paper to be folded to a paper folding machine. The continuous paper feeder includes means for introducing a gas between sheets of a stack of paper, paper stock, cardboard, and similar materials that are fed to a paper folding machine. Also provided is a paper folding machine including the continuous paper feeder and a method for feeding paper to a paper folding machine using the continuous paper feeder.

BACKGROUND

Paper folding machines are well known in the paper handling industry. In general, paper folding machines have the capability of performing folding operations on lengths of continuous sheets or multiple separate sheets of paper that are continuously fed into the paper folding machine.

In the operation of certain types of paper folding machines, an operator loads a desired quantity of paper sheets onto a sheet feeder table. The loaded sheets of paper are loaded onto a feed path and directed into a paper folding region of a paper folding machine. The leading edge of the paper sheets are drawn into the paper folding region that is located downstream from the sheet feeder region.

For reasons of efficiency of time and labor, it is common to load a stack of individual sheets of paper to be folded onto the paper folding machine. The stacks of paper generally include a very large number of sheets of paper compared to the number of sheets that is possible for the sheet feeder to process simultaneously. As such, the stack of paper must be spread or fanned out along a feed path such that the number of sheets presented to the sheet feeder at any given time is less than the number of sheets in the loaded stack. The fanning operation takes the number of sheets in the original load stack and distributes them over a broader area, thereby forming leading and trailing edges of the stack. These edges comprise less sheets per unit area than the original stack and thus reduces the number of sheets presented to the sheet feeder for simultaneous processing.

Many types of paper are provided with polymer coatings to protect the paper or to enhance the appearance of the paper, and such types of paper have enjoyed widespread commercial success. The use of coated paper stock, however, increases the weight of the stacks of paper that need to be loaded onto the paper folding machine for the paper folding operation. The repetitive operation of loading stacks of heavy coated paper stock onto the paper folding machine by the operator of the paper folding machine creates great physical stress on the human body, especially on the arms, wrists and back. Thus, while fanning the sheets of a stack is a required process step in the course of operation of certain paper folding machines, fanning is a repetitive and labor intensive task.

Accordingly, it is desirable to provide means to assist the paper folding machine operator with loading large stacks of paper onto a continuous paper feeder for a paper folding machine.

SUMMARY

Provided is a continuous paper feeder for a paper folding machine comprising: a conveyor comprising an axis of conveyance having a upstream direction and a downstream direction; a paper guide positioned along said axis of conveyance, said guide comprising opposite facing first and second surfaces and a plurality of apertures communicating between said first and second surfaces; and a gas delivery means for selectively flowing gas through at least one of said apertures; and means for controlling the output of flowing gas from said gas delivery means.

Also provided is a paper folding apparatus comprising a conveyor comprising an axis of conveyance having a upstream direction and a downstream direction; a paper guide positioned along said axis of conveyance, said guide comprising opposite facing first and second surfaces and a plurality of apertures communicating between said first and second surfaces; and a gas deliver means for selectively flowing gas through at least one of said apertures; and means for controlling the output of flowing gas from said gas delivery means; and at least one paper folding means. According to certain embodiments, the paper folding means is located downstream from said sheet feeder.

Further provided is a method for folding paper comprising loading a stack of paper onto a continuous paper feeder comprising a conveyor comprising an axis of conveyance having a upstream direction and a downstream direction; a paper guide positioned along said axis of conveyance, said guide comprising opposite facing first and second surfaces and a plurality of apertures communicating between said first and second surfaces; and a gas delivery means for selectively flowing gas through at least one of said apertures; and means for controlling the output of flowing gas from said gas delivery means; and continuously feeding paper to a paper folding machine.

DETAILED DESCRIPTION

Figure 1:
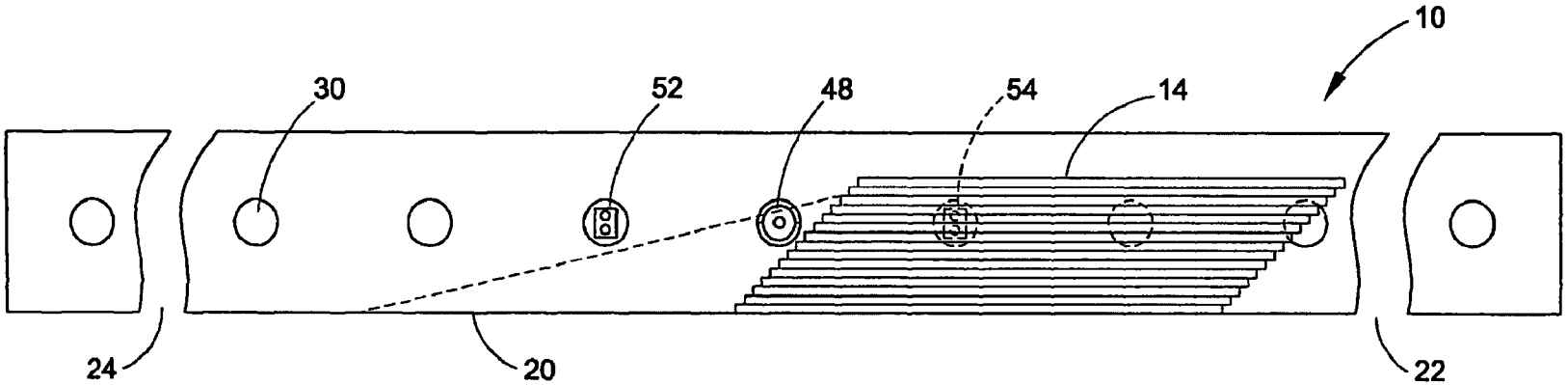
FIG. 1 is a side view of one illustrative embodiment of the elongated guide of the continuous paper feeder.

Disclosed is a continuous paper feeder for a paper folding machine, a paper folding machine including the continuous paper feeder, and a method for using the continuous paper feeder to deliver paper to a paper folder. According to certain illustrative embodiments, the continuous paper feeder includes a conveyor, a paper guide, a gas delivery means, an actuator for moving the gas delivery means, a motor for driving the actuator, a controller, and a set of sensors.

The continuous paper feeder includes a conveyor for conveying paper to be folded, means for delivering gas across the conveyor, wherein the means for delivering the gas is selectively movable along at least a portion of length of the conveyor. The gas delivery means selectively travels along the long axis of the conveyor in response to the presence or absence of a certain amount or level of paper loaded onto the conveyor. The continuous paper feeder further includes means for controlling the output of gas from the gas delivery means and means for controlling the travel and positioning of the output of the gas delivery means.

The paper feeder includes an elongated conveyor, the conveyor comprising an axis of conveyance having an upstream direction and a downstream direction. The feeder also comprises an elongated guide or side wall that is positioned in close proximity to, or that is otherwise engaged with, the conveyor along the axis of conveyance. The elongated guide may comprise a first surface that is proximal to the conveyor, a second surface that is distal from the conveyor, and a plurality of apertures in communication with the first and second surfaces of the guide. The paper feeder also comprises a gas delivery means, such as a blower system, that is capable of introducing a flowing gas across the conveyor through the apertures. The blower system comprises a blower, a conduit, including an input engaged to the blower and an output that is movably engaged with a carriage attached to, engaged with, or otherwise placed in close proximity to the elongated guide. The blower system optionally includes a valve for controlling gas flow from the blower. The paper feeder also comprises an actuator that is adapted to move the output and sensors along at least a portion of the axis of conveyance and a motor that is adapted to control the actuator and a set of sensors engaged to the output. The set of sensors comprises a plurality of sensors in which at least one of the sensors is located on the upstream side of the output and at least one of the sensors is located on the downstream side of the output. The set of sensors are in communication with the motor.

A method is also provided for loading a stack of paper to be folded onto the continuous paper feeder for delivery to a paper folder. The stack of paper to be folded is loaded onto the conveyor of the feeder by fanning the stack of paper in the upstream direction of the axis of conveyance of the continuous paper feeder. The method comprises loading a stack of paper onto an elongated conveyor, the conveyor comprising an axis of conveyance having a upstream direction and a downstream direction. The feeder also includes an elongated guide that is positioned in close proximity to, or that is otherwise attached to or engaged with the conveyor along the axis of conveyance. The guide comprises a first surface that is proximal to the conveyor, a second surface that is distal from the conveyor, and a plurality of apertures in communication with the first surface and the second surface.

The continuous feeder used in the method also comprises a gas delivery means, such as a blower, that is adapted to introduce a flowing gas across the conveyor through the apertures on the guide. The blower system comprises a blower, a conduit including an input engaged to the blower and an output movably engaged with a carriage that is positioned in close proximity to the second surface of the guide. The blower may also include a valve for controlling gas flow. The feeder also comprises an actuator adapted to move the output along at least a portion of the axis of conveyance, a motor adapted to control the actuator, and a set of sensors engaged to the carriage.

The set of sensors comprises a plurality of sensors in which at least one of the sensors is positioned on the upstream side of the output and at least one of the sensors is positioned on the downstream side of the output. The set of sensors are in communication with the smart motor. The method also comprises causing the conveyor to move a stack of paper introduced thereto downstream; introducing a stack of paper to the conveyor, the stack having a leading edge and a trailing edge, and detecting the leading edge of the stack of paper by at least one of the sensors. The method also comprises, optionally, adjusting the gas flow from the gas delivery means. The method also comprises causing the actuator to move the output upstream with respect to the axis of conveyance; and detecting the trailing edge of the stack of paper by at least one of the sensors. The method also comprises optionally, adjusting the gas flow and, optionally, causing the actuator to move the conduit downstream with respect to the second surface.

The conveyor comprises an elongated conveyor comprising an axis of conveyance. This conveyance axis has both upstream and downstream directions, with the upstream direction being the direction from which material is conveyed and the downstream direction being the direction to which material is conveyed. In certain embodiments, the conveyor has a substantially planar conveying surface. In certain embodiments, the conveyor is substantially linear. Without limitation, in one embodiment the conveyor comprises a conventional conveyor belt. Alternatively, the conveyor may comprise a plurality of rollers positioned in a parallel side-by-side relationship.

The guide comprises an elongated guide which is positioned in close proximity to the conveyor. The elongated guide includes opposite facing first and second side surfaces. The guide includes first surface, proximal to the conveyor, which guides material being conveyed by the conveyor. The guide includes a second surface which is distal from the conveyor. The guide includes apertures which communicate between the first surface and the second surface of the guide. In certain embodiments, the guide is substantially linear. In certain embodiments the guide is substantially planar. In certain embodiments, the guide is substantially perpendicular to the conveyor. Without limitation, in one embodiment the guide comprises a straight rectangular plate or strap which is positioned substantially perpendicular to the conveyor. In certain embodiments the apertures are cylindrical though holes in the guide. It should be noted, however, that the geometry of the apertures is not limited to cylindrical holes. As such, according to other illustrative embodiments, the apertures of the elongated guide may comprise a plurality of spaced-apart elongated slots arranged parallel to one another.

While the elongated guide of the continuous paper feeder has been described in connection with a continuous guide having a plurality of apertures, it should be noted that the guide may be provided as a plurality of discontinuous plates that are positioned substantially perpendicular to the conveyance surface. The discontinuous plates may or may not include apertures. For embodiments where the discontinuous guide plates include apertures, the blower may selectively flow gas through the gaps between the plurality of discontinuous plates, through the apertures or both. Alternatively, gas can be introduced across the conveyor though spaces provided between the upper surface of the conveyor and a side edge of the elongated guide.

The gas delivery means comprises a device for introducing a flow of gas through the apertures located on the elongated guide. According to certain embodiments, the gas delivery means comprises a blower. The blower comprises a source element, a conduit, and optionally, flow control elements.

The blower comprises a source element in which there is a region of gas. The region of gas has a pressure or velocity or both such that the gas can be easily delivered to the stack of paper loaded onto the conveyor surface to be fanned and fed to the paper folding machine. Without limitation, the source element may comprise a tank, bottle, or other container in which the gas is stored at a pressure higher than atmospheric pressure. Without limitation, the source element may comprise a compressor, or blower, or fan which may intake a volume of gas and flow the gas across the conveyor.

The blower comprises a conduit to move a gas from the source element to the paper load onto the conveyance surface of the continuous paper feeder. The conduit may comprise a pipe, hose, duct, tube, or any other structure comprising an input in fluid communication with an output. The conduit comprises an input in fluid communication with the source element and an output movably positioned near the second surface of the guide. The output is capable of moving along at least a portion of the length of the guide in the direction corresponding to upstream on the conveyor, the upstream direction, and is capable of moving along at least a portion of the length of the guide in the direction corresponding to downstream on the conveyor, the downstream direction. The conduit may be flexible, like a hose, or rigid like a pipe. The conduit may also comprise joints, seals, fitting, or valves. In certain embodiments, it may be possible for the output to move with respect to the input. In embodiments in which it is possible for the output to move with respect to the input, it is not necessary for the input to be movable with respect to the second surface of the guide.

Certain embodiments comprise flow control elements to control flow of gas from the blower. Flow control elements may be either elements which govern rate of output from the blower, such as a valve or gate or constriction, or which govern rate of input to the blower such a switch or clutch.

The gas may be any gas which can physically agitate the component sheets in a stack of paper by flowing across them. Such gases may comprise air, nitrogen, oxygen, argon, carbon dioxide, helium or combinations thereof.

Without limitation, in certain embodiments, the blower comprises a fan, blower, or compressor which intakes ambient atmospheric air, adds head to the intake air, in the form of additional pressure or additional velocity or both, and expels said air to the conduit such that said air issues from the output of the conduit to the stack of paper to be folded. The issuance of the air from the output in such an embodiment may be controlled by controlling the source element, the fan, blower, or compressor via a switch or clutch. Alternatively, the issuance of the air from the output in such an embodiment may be controlled by a valve, gate, or constriction which block or redirects air flow from issuing to the stack.

The set of sensors are a group of sensors capable of detecting the presence of material, such as a stack of paper to be folded, on the conveyor. The sensors are intended to detect the presence of paper stacks of pre-determined height, but may be of such technology that other types of material may also be detected. In certain embodiments, and without limitation, the sensors are photocells, capacitive sensors, or other sensors capable of detecting material proximity. In certain embodiments, the sensors detect the presence of a beam of electromagnetic radiation emitted in such a way that the gas delivery means crosses the conveyor at least once. In such an embodiment, material on the conveyor of a particular height will occlude the beam and allow detection of the material indirectly by absence of detection of the beam. In such embodiments, the electromagnetic radiation emitted may be light, infrared radiation, ultraviolet radiation, or any other sort of suitable electromagnetic radiation.

In certain embodiments, the sensors are engaged to a carriage that also engages the gas delivery means output. In certain embodiments, the gas delivery means output is flanked by sensors; that is, there is at least one sensor on the upstream side of the output and there is at least one sensor on the downstream side of the output.

The continuous paper feeder includes an actuator for moving the gas delivery means output and any sensors engaged therewith along the elongated guide. The input to an actuator and the output from the actuator depend upon its type. In certain embodiments, the actuator is a linear actuator. A linear actuator is a device for moving a system linearly. Linear actuators can be mechanical, hydraulic, piezoelectric, electromechanical, pneumatic, or otherwise. Certain types of linear actuators accept rotational input and produce linear output. Without limitation, two kinds of linear actuators that accept rotational input and produce linear output are ball-screw driven linear actuators and belt-driven linear actuators. In certain embodiments, the actuator is a belt-driven linear actuator. In certain embodiments, the actuator is a Macron™ PSC-28 Linear Actuator available from MACRON DYNAMICS, INC., 460 Caredean Drive, Horsham, Pa. 19044.

The continuous paper feeder includes a smart motor to control the flow and position of gas flowing form the gas delivery means. The smart motor is a motor that is integrated with a controller. The smart motor receives data from the sensors and drives the actuator in response to the data received.

The continuous paper feeder and method for delivering a stack of paper will be described with respect to the illustrative embodiments shown in FIGS. 1-3. It should be noted that the embodiments show in FIGS. 1-3 are intended to be merely illustrative and should not be considered to limit the paper feeder, folding machine or method in any manner.

Referring to FIG. 1, a partial view of one illustrative embodiment of the continuous paper feeder 10 is shown. In this embodiment, the guide 20 is a rectangular linear plate. The apertures 30 in the guide are circular cross-section through holes. The guide is shown with breaks at 22 and 24 to indicate indeterminate length. FIG. 1 also shows the output 48 of the conduit 44 of the blower 40. Also shown are sensors 52 and 54. Sensor 52 is upstream of output 48. Sensor 54 is downstream of output 48. Also shown is the stack of paper 14 which is being conveyed by the conveyor (not shown). The cross-section of the stack of paper 14 is shown as a trapezoid to represent the fact that the stack has been fanned out such that the upper sheets of the stack of paper 14 are further downstream than are the lower sheets of the stack of paper 14.

Figure 2:
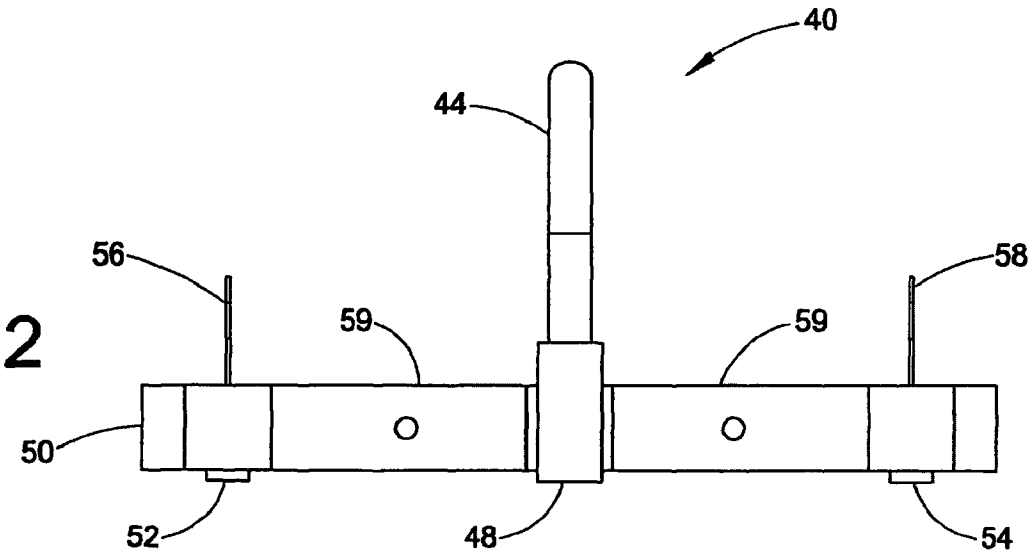
FIG. 2 is a top plan view of one illustrative embodiment of a blower outlet and an engaged sensor set.
Figure 3:
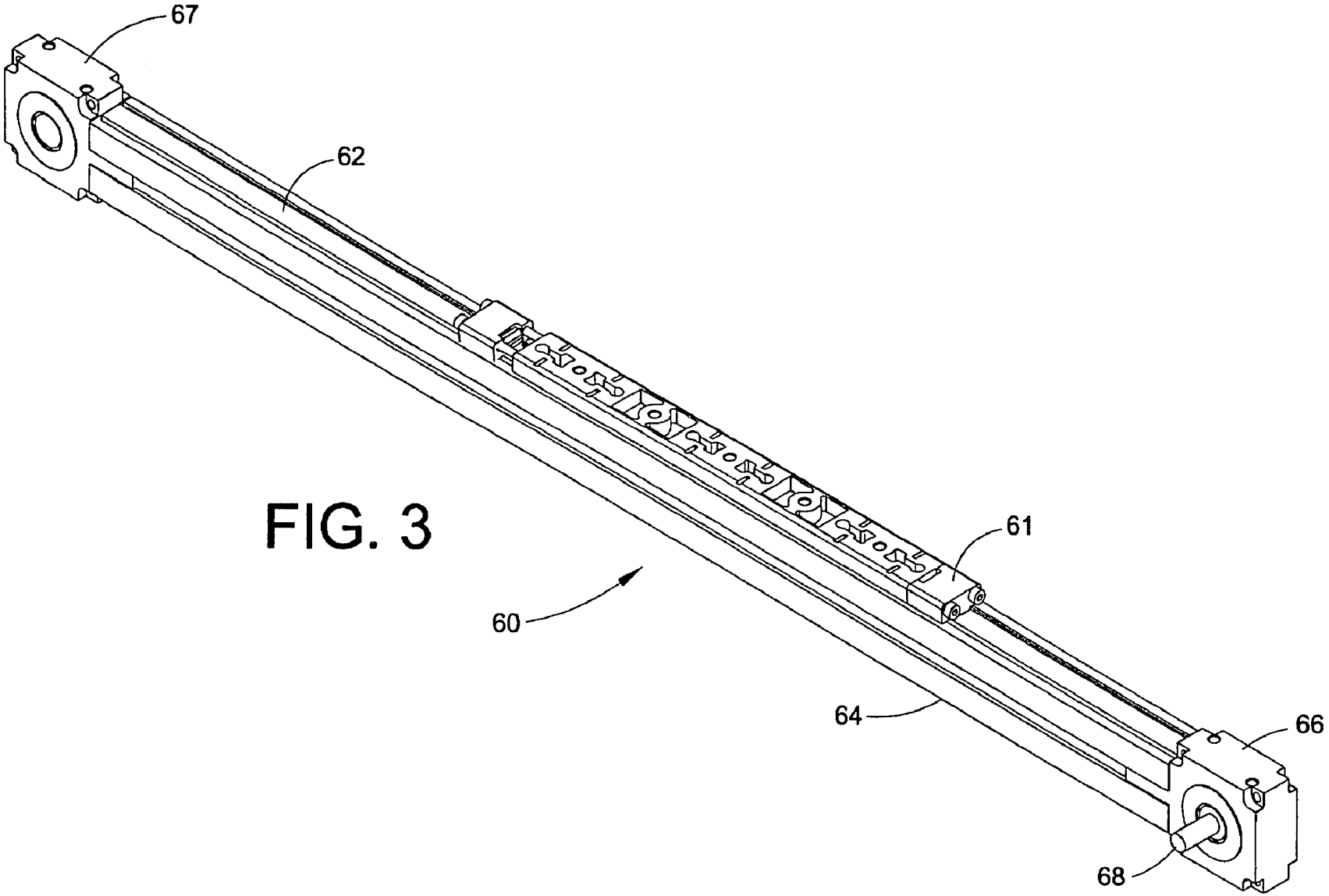
FIG. 3 is a perspective view of one illustrative embodiment of the actuator of the continuous paper feeder.

Referring to FIG. 2, a partial plan view of one embodiment of the blower system 40 and an engaged sensor set. This view shows a carriage 50 carrying the blower conduit 44 and sensors 52, 54. The view shows a conduit 44 and the output 48 of the conduit 44. Engaged with the conduit 44 by struts 59 are sensors 52 and 54. Sensor 52 is upstream of output 48. Sensor 54 is downstream of output 48. Leads 56, 58 are used to electrically connect the sensors 52, 54 with the motor.

In the embodiments shown in FIG. 1 and FIG. 2, the sensors 52 and 54 are each offset from the outlet 48 by an integral multiple of the distance that the apertures 30 are spaced from one another. This offset allows the sensors 52 and 54 to simultaneously receive information through an aperture 30 while the outlet 48 is aligned with another such aperture 30.

Referring to FIG. 3, a perspective view of one embodiment of an actuator 60 is illustrated. The actuator 60 shown is a linear actuator. The model is a Macron™ PSC-28 Linear Actuator available from MACRON DYNAMICS, INC., 460 Caredean Drive, Horsham, Pa. 19044. The actuator 60 is a belt driven linear actuator. The actuator 60 comprises an elongated frame 64. At either end of the elongated frame 64 is a pulley 66 and 67 about which belt 62 is looped. As shown, one pulley 66 incorporates a shaft 68 for engagement with a motor or other rotational input (not shown). Along the belt 62 is a carriage 61. The carriage 61 is an engagement region to which the blower output (not shown) and sensors to be conveyed by the actuator 60 may be engaged.

Figure 4A:
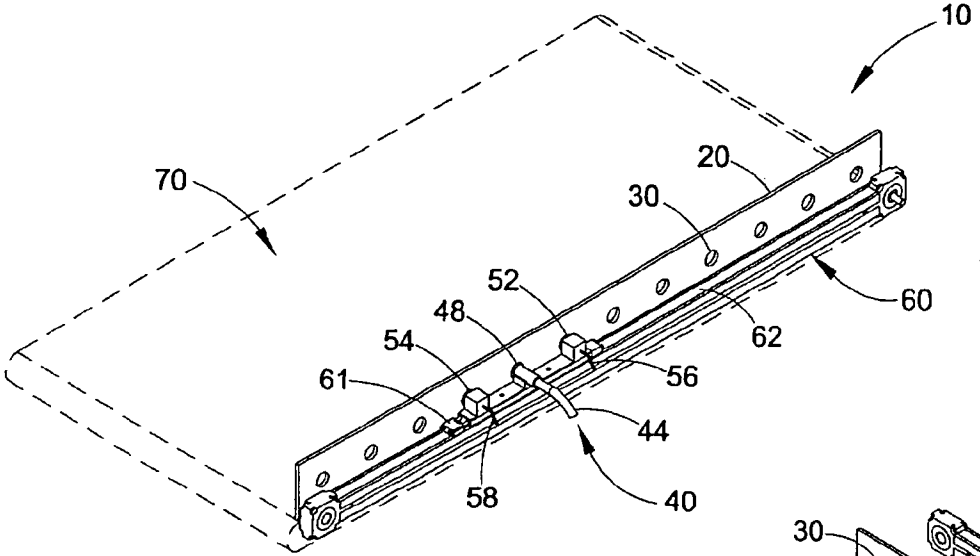
FIG. 4A is a perspective view of the back side of the elongated guide with blower outlet engaged therewith and showing positioning relative to the conveyor.
Figure 4B:
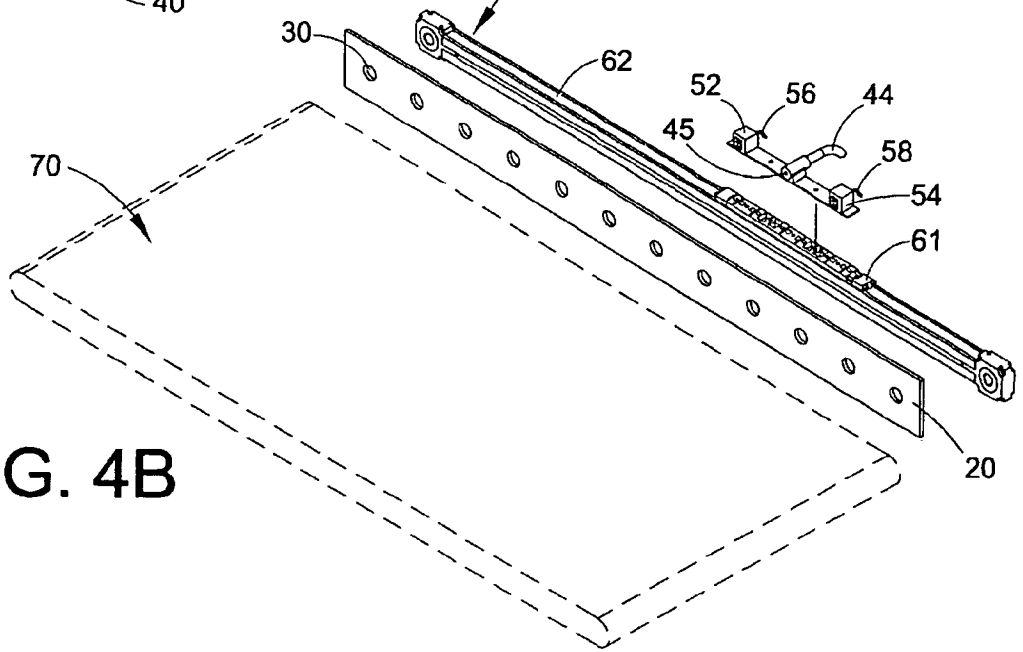
FIG. 4B is an exploded perspective view of the front side of the elongated guide, actuator, and blower outlet, and shoving positioning relative to the conveyor.

FIGS. 4A and 4B show perspective views of the conveyance surface 70, elongated guide 20 with apertures 30, linear actuator 60, carriage 61, blower conduit output 48 and sensors 52, 54 flanking the output 48. In FIG. 4A, the carriage 61 is positioned such that blower output 48 and sensors 52, 54 are aligned with adjacent, spaced-apart apertures 30. Accordingly, sensors 52, 54 are able to detect the absence or presence of a stack of paper on the conveyance surface of the conveyer 70 and blower output 48 will be able to deliver gas across the conveyor 70 through aperture 30 if the data received by the blower indicates the presence of paper on the conveyor 70 that requires the introduction of gas.

Figure 5:
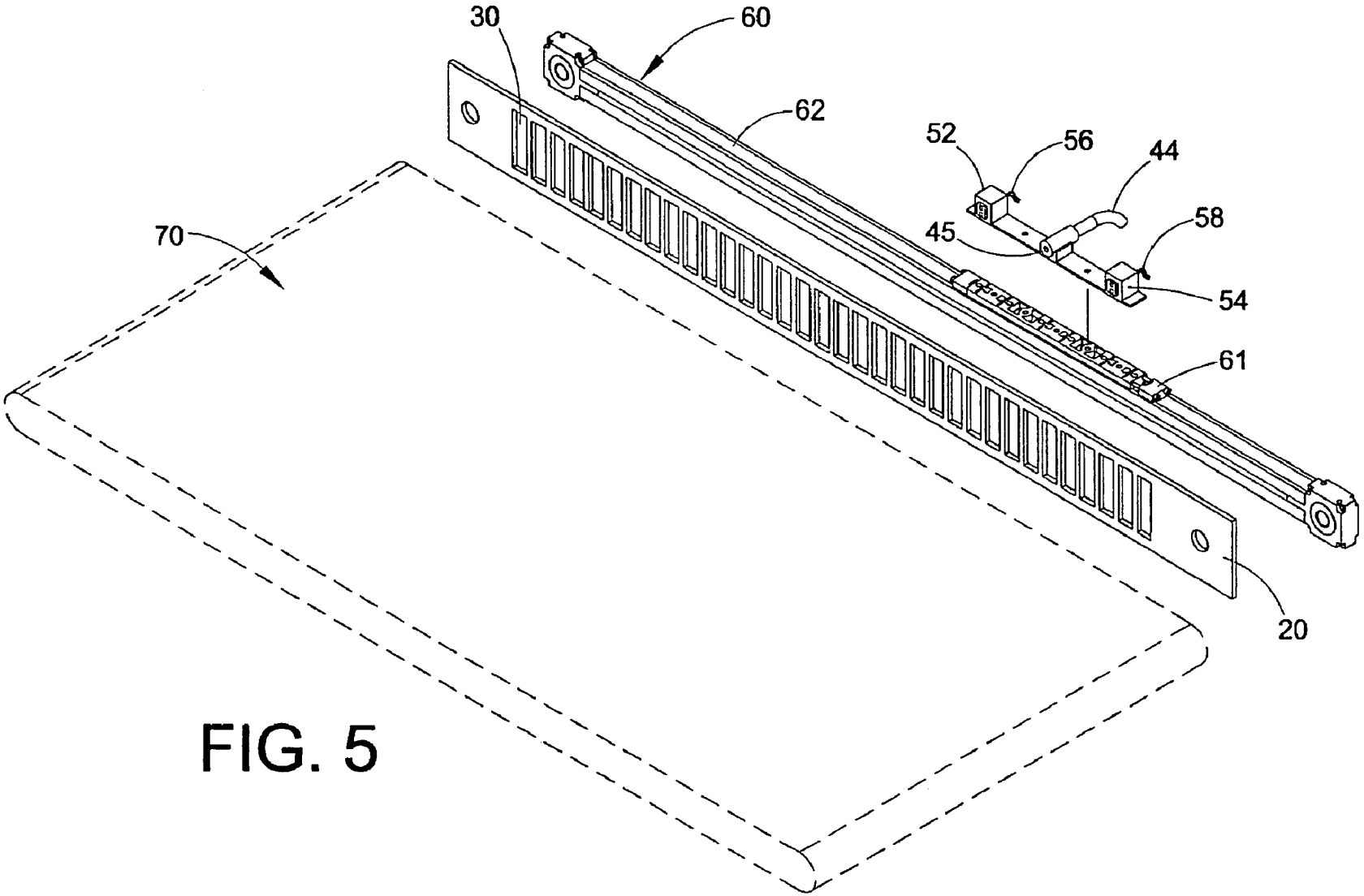
FIG. 5 is an exploded perspective view of the front side of another illustrative embodiment of the elongated guide, actuator, and blower outlet, and showing positioning relative to the conveyor.

FIG. 5 shows another illustrative embodiment of the continuous paper feeder for a paper folding machine. The continuous paper feeder includes a conveyor 70 having a surface to convey paper. Elongated wall or paper guide 20 is provided along a lateral side of conveyor 70. According to the embodiment shown, although not necessary, the guide 20 extends substantially along the entire length of the later side of the conveyor. Elongated guide includes a plurality of slots 30 that are arranged substantially perpendicular to the long axis of the paper guide 20. The guide 20 has a first side that it proximal to the conveyor 70 and a second side that is distal to the conveyor. Positioned adjacent to the distal side of paper guide 20 is actuator 60. The actuator shown in the embodiment of FIG. 5 is the same as actuator 60 described in connection with FIGS. 3, 4A and 4B above. Linear actuator 60, carriage 61, blower conduit output 48 and sensors 52, 54 flanking the output 48 are shown. Carriage 61 is positioned such that blower output 48 and sensors 52, 54 are aligned with adjacent, spaced-apart apertures 30. Accordingly, sensors 52, 54 are able to detect the absence or presence of a stack of paper on the conveyance surface of the conveyer 70 and blower output 48 will be able to deliver gas across the conveyor 70 through aperture 30 if the data received by the blower indicates the presence of paper on the conveyor 70 that requires the introduction of gas.

The method for loading a stack of paper onto a continuous paper feeder and delivering such paper to a paper folder comprises the use of the paper feeder herein described. The method may optionally begin with an adjustment to the element for controlling the gas flow to achieve the desired flow rate. The method causes the conveyor to move in a manner that conveys material introduced upon it downstream. The method includes loading a stack of paper to be fed to a paper folding machine onto the surface of the conveyor. When the paper is loaded onto the conveyor surface in manner that the sensors 52, 54 positioned on either side of the blower output 48 are occluded and do not detect a beam of light. (i.e.—neither of the sensors "see" any light). When the sensors are occluded, the blower turns on and air flows from blower output 48 through the apertures 30 of the elongated guide 20 to the conveyor 70 to reach the paper. While the air is flowing through the apertures 30, the operator loading the paper fins the stack or paper upstream along the axis of conveyance forming an inclined stack of paper having a leading edge downstream from a trailing edge. While the operator is fanning the paper upstream along the axis of conveyance, the actuator 60 moves the carriage 61, carrying the blower output 48 and sensors 52, 54, incrementally upstream along the axis of conveyance until both sensors are no longer occluded by the stack of paper. When both sensors are no longer occluded by the paper stack, the system senses that it has reached the trailing edge of the inclined paper stack and the blower turns off. When the blower is in the off condition, no gas flows from the output 48 to the conveyor 70.

After the blower turns off and air is no longer flowing, actuator 60 moves the carriage 61 carrying the blower output 48 and sensors 52, 54 a predetermined distance upstream from the paper stack, the system pauses to reset, and then the carriage 61 moves downstream until sensor 54, which is positioned downstream of blower output 48, becomes occluded by the include paper stack near the trailing edge of the stack. In this position, sensor 54 will be occluded by a stack a paper, while sensor 52 is not. The carriage 61 will then follow the trailing edge of inclined paper stack downstream until the operator loads another stack of paper onto the conveyor surface, thereby occluding both sensors and activating the flow of air from the blower 40.

The sensors 52, 54 sense the presence or absence of a certain level of paper on the conveying surface of the conveyor. This information is processed and transmitted to the motor and blower to control the operation of these components of the paper feeder. The sensors 52, 54 transmit data back to the motor to control the movement of the actuator and carriage along the length of the long axis of the elongated guide 20 and conveyer 70. Likewise, sensors 52, 54 transmit data back to the blower controller to control the operation of the blower (ie, to control when the blower is turn off and on). Control boxes or housings may be used to house the necessary components to run the blower and/or electric motor, such as controllers, transformers, relays and the like.

The continuous paper feeder may also include a rheostat to vary and control the level of flow of air from the blower. The continuous paper feeder may further include a potentiometer to vary and control the frequency of the index of the blower at different points along the axis of conveyance.

The paper folding machine comprises the continuous paper feeder in communication with a paper folding mechanism. The conveyor of the continuous feeder is supported by a frame and delivers sheets of paper to be folded to the sheet folding mechanism. The paper folding mechanism is located downstream from said continuous feeder. A non-limiting example of a paper folder that may be used with the continuous feeder is a buckle-type folder. In a buckle-type folder, a piece of paper is fed or pulled through two elongated adjacent rollers that direct the leading edge of the piece of paper into a tray or a chute that is of a finite length and which stops the leading edge of the paper at a predetermined distance from the rollers. Once the leading edge hits the end of the chute, the paper is confined as it is buckled by the first pair of rollers which are still advancing the sheet of paper. The buckled portion of the piece of paper is then caught between another pair of rollers positioned next to the first pair of rollers. The second pair of rollers pull the buckled portion through, thereby creating a folded piece of paper.

While the continuous paper feeder, paper folding machine and method have been described in connection with various embodiments, as shown in the various figures, it is to be understood that other similar embodiments may be used or modifications and additions may be made to the described embodiments for performing the same function without deviating therefrom. Furthermore, the various illustrative embodiments may be combined to produce the desired results. Therefore, the paper feeder, folding machine or method should not be limited to any single embodiment, but rather construed in breadth and scope in accordance with the recitation of the appended claims.

I claim:

1. A paper feeder for continuously feeding a sheets of paper to a paper folding machine comprising:

a conveyor comprising an axis of conveyance having a upstream direction and a downstream direction;

a paper guide positioned along said axis of conveyance, said guide comprising opposite facing first and second surfaces and a plurality of apertures communicating between said first and second surfaces;

a gas delivery means having an output movable in said upstream and downstream directions along at least a portion of the length of said paper guide for selectively delivering gas through at least one of said apertures to said sheets of paper; and means for controlling the positioning of an output of said gas delivery means; and means for controlling the output of flowing gas from said gas delivery means.

2. The paper feeder of claim 1, wherein said conveyor comprises an endless conveyor belt providing a conveyance surface.

3. The paper feeder of claim 1, wherein said conveyor comprises a plurality of rollers providing a conveyance surface.

4. The paper feeder of claim 1, wherein said paper guide comprises a metal plate, metal alloy plate, or composite material plate.

5. The paper feeder of claim 4, wherein said paper guide comprises a metal plate.

6. The paper feeder of claim 5, wherein said paper guide is positioned substantially perpendicular to the conveyance surface.

7. The paper feeder of claim 1, wherein said gas delivery means comprises:

a source element;

a gas outlet in fluid communication with said source element; and optionally, an element for controlling gas flow.

8. The paper feeder of claim 7, wherein said outlet comprises a flexible conduit.

9. The paper feeder of claim 8, wherein said conduit is sufficiently flexible to permit said outlet to be moved along said axis of conveyance in close proximity to said second surface of said paper guide.

10. The paper feeder of claim 1, further comprising an actuator adapted to move said gas delivery outlet along said axis of conveyance.

11. The paper feeder of claim 10, further comprising a motor to drive said actuator.

12. The paper feeder of claim 11, wherein said actuator comprises a linear belt actuator.

13. The paper feeder of claim 12, further comprising a gas delivery means controller in communication with said motor.

14. The paper feeder of claim 1, comprising a set of sensors in communication with said gas delivery means controller.

15. The paper feeder of claim 14, wherein at least one of said sensors of said set of sensors is mounted on the upstream side of the outlet of said gas delivery means and at least one of said sensors is mounted on the downstream side of the outlet of said gas delivery means.

16. The paper feeder of claim 15, wherein said sensors comprise a set of photo eyes.

17. The paper feeder of claim 1, wherein said apertures comprise cylindrical through holes.

18. The paper feeder of claim 1, wherein said apertures comprise a plurality of spaced apart slots.

19. The paper feeder of claim 1, wherein said gas comprises air.

20. A paper folding machine comprising:

(i) a sheet feeder comprising:

a conveyor comprising an axis of conveyance having a upstream direction and a downstream direction;

a paper guide positioned along said axis of conveyance, said guide comprising opposite facing first and second surfaces and a plurality of apertures communicating between said first and second surfaces;

a gas delivery means having an output movable in upstream and downstream directions along at least a portion of the length of said paper guide for selectively delivering gas through at least one of said apertures to said sheets of paper; and means for controlling the positioning of an output of said gas delivery means;

means for controlling the output of flowing gas from said gas delivery means; and (ii) at least one paper folding means.

21. The paper folding machine of claim 20, wherein said at least one paper folding means is located downstream from said sheet feeder.

22. The paper folding machine of claim 21, wherein said conveyor comprises an endless conveyor belt providing a conveyance surface.

23. The paper folding machine of claim 21, wherein said conveyor comprises a plurality rollers providing a conveyance surface.

24. The paper folding machine of claim 20, wherein said paper guide comprises a metal plate, metal alloy plate, or composite material plate.

25. The paper folding machine of claim 24, wherein said paper guide comprises a metal plate.

26. The paper folding machine of claim 25, wherein said paper guide is positioned substantially perpendicular to the conveyance surface.

27. The paper folding machine of claim 20, wherein said gas delivery means comprises:

a source element;

a gas outlet in fluid communication with said source element; and optionally, an element for controlling gas flow.

28. The paper folding machine of claim 27, wherein said outlet comprises a flexible conduit.

29. The paper folding machine of claim 28, wherein said flexible conduit is sufficiently flexible to permit said outlet to be moved along said axis of conveyance in close proximity to said second surface of said elongated guide.

30. The paper folding machine of claim 20, further comprising an actuator adapted to move said gas delivery means output along said axis of conveyance.

31. The paper folding machine of claim 30, further comprising a motor to drive said actuator.

32. The paper folding machine of claim 31, wherein said actuator comprises a linear belt actuator.

33. The paper folding machine of claim 32, further comprising a gas delivery means controller in communication with said motor.

34. The paper folding machine of claim 33, wherein said means for controlling the output of flowing gas from said gas delivery means comprises a set of sensors engaged to a carriage and in communication with said motor.

35. The paper folding machine of claim 34, wherein at least one of said sensors of said set of sensors is mounted on the upstream side of the outlet of said gas delivery means and at least one of said sensors is mounted on the downstream side of the outlet.

36. The paper folding machine of claim 35, wherein said sensors comprise a set of photo eyes.

37. The paper folding machine of claim 20, wherein said apertures comprise cylindrical through holes.

38. The paper folding machine of claim 20, wherein said apertures comprise a plurality of spaced apart slots.

39. The paper folding machine of claim 20, wherein said gas comprises air.

40. A paper feeder for continuously feeding sheets of paper to a paper folding machine comprising:

an elongated paper guide comprising opposite facing first and second surfaces and a plurality of apertures communicating between said first and second surfaces;

a gas delivery means having an output positioned adjacent said second surface of said elongated paper guide for selectively delivering gas through at least one of said apertures from said second surface to said first surface of said elongated paper guide;

means for moving said gas delivery means output and sensors along at least a portion of the length of said elongated paper guide;

a motor for driving the means for moving said gas delivery means output and said sensors;

a gas delivery means controller in communication with said motor; and sensors for receiving data and transmitting said data to said motor and to said gas delivery means controller.

* * * * *